US012006652B2

(12) United States Patent
Kleibl et al.

(10) Patent No.: US 12,006,652 B2
(45) Date of Patent: Jun. 11, 2024

(54) CONSTRUCTION MACHINE FOR SPECIAL CIVIL ENGINEERING

(71) Applicant: ABI Anlagentechnik-Baumaschinen-Industriebedarf Maschinenfabrik und Vertriebsgesellschaft mbH, Niedernberg (DE)

(72) Inventors: Albrecht Kleibl, Grossostheim (DE); Christian Heichel, Niedernberg (DE)

(73) Assignee: ABI ANLAGENTECHNIK-BAUMASCHINEN-INDUSTRIEBEDARF MASCHINENFABRIK UND VERTRIEBSGESELLSCHAFT MBH, Niedernberg (DE)

( * ) Notice: Subject to any disclaimer, the term of this patent is extended or adjusted under 35 U.S.C. 154(b) by 447 days.

(21) Appl. No.: 17/388,384

(22) Filed: Jul. 29, 2021

(65) Prior Publication Data

US 2022/0064891 A1 Mar. 3, 2022

(30) Foreign Application Priority Data

Sep. 3, 2020 (EP) ..... 20194280

(51) Int. Cl.
*E21B 7/02* (2006.01)
*E02D 7/08* (2006.01)
(Continued)

(52) U.S. Cl.
CPC ..... *E02D 7/16* (2013.01); *E02D 7/08* (2013.01); *E21B 7/023* (2013.01); *E21B 15/003* (2013.01)

(58) Field of Classification Search
CPC ..... E02D 11/00; E02D 17/13; E02D 7/08; E02D 7/16; E21B 15/003; E21B 7/023
See application file for complete search history.

(56) References Cited

U.S. PATENT DOCUMENTS 3,717,205 A * 2/1973 Wilderman ..... E21B 19/084 173/147
3,719,238 A * 3/1973 Campbell ..... E21B 19/084 175/203
(Continued)

FOREIGN PATENT DOCUMENTS

DE 20 57 889 A1 6/1972
EP 1 655 415 A1 5/2006
(Continued)

OTHER PUBLICATIONS

European Search Report in EP 20194280.2-1002, dated Jan. 28, 2021, with English translation of relevant parts.

*Primary Examiner* — Daniel P Stephenson
(74) *Attorney, Agent, or Firm* — Collard & Roe, P.C.

(57) ABSTRACT

A construction machine for special civil engineering has a leader on which an advancing carriage is guided, which carriage has a holder for a work device, in particular a drilling rig or pile-driving implement, and which can be moved along the leader by way of a first advancing cable (upper cable) and a second advancing cable (lower cable), by way of a drive winch or a drive cylinder, wherein the advancing carriage is connected with the advancing cables and wherein at least one of the advancing cables is attached to a fixed point on the leader and/or the advancing carriage, wherein at least one fixed point is formed by a cable tensioner attached to the leader or the advancing carriage. At least one cable tensioner includes a tensioning drum on which an end-side section of an advancing cable is attached with multiple cable windings.

16 Claims, 9 Drawing Sheets

(51) Int. Cl.
*E02D 7/16* (2006.01)
*E21B 15/00* (2006.01)

(56) References Cited

U.S. PATENT DOCUMENTS

| | | | | | |
|---|---|---|---|---|---|
| 4,103,745 | A * | 8/1978 | Varich | E21B 3/02 | 173/147 |
| 4,137,974 | A * | 2/1979 | Decker | E21B 44/02 | 173/147 |
| 4,150,727 | A * | 4/1979 | Shepherd | E21B 19/084 | 173/147 |
| 4,296,819 | A * | 10/1981 | Griste | E21B 19/084 | 173/147 |
| 4,544,040 | A * | 10/1985 | Sweeney | E21B 1/02 | 173/147 |
| 5,213,169 | A * | 5/1993 | Heller | E21B 21/12 | 175/215 |
| 6,536,541 | B2 * | 3/2003 | Pedrelli | E02D 5/34 | 175/203 |
| 7,341,157 | B2 * | 3/2008 | Slobogean | B66C 23/00 | 212/250 |
| 8,567,519 | B2 | 10/2013 | Poeckl | | |
| 2006/0096941 | A1 | 5/2006 | Stoetzer | | |
| 2011/0253400 | A1 * | 10/2011 | Poeckl | E21B 7/023 | 173/1 |
| 2022/0064891 | A1 * | 3/2022 | Kleibl | E21B 7/023 | |

FOREIGN PATENT DOCUMENTS

| | | | |
|---|---|---|---|
| EP | 2 378 001 | A1 | 10/2011 |
| JP | H09-217349 | A | 8/1997 |

* cited by examiner

CONSTRUCTION MACHINE FOR SPECIAL CIVIL ENGINEERING

CROSS REFERENCE TO RELATED APPLICATIONS

Applicant claims priority under 35 U.S.C. § 119 of European Application No. 20194280.2 filed Sep. 3, 2020, the disclosure of which is incorporated by reference.

BACKGROUND OF THE INVENTION

1. Field of the Invention

The invention relates to a construction machine for special civil engineering, having a leader on which an advancing carriage is guided, which carriage has a holder for a work device, in particular a drilling rig or pile-driving implement.

2. Description of the Related Art

Rotary drilling implements are used in special civil engineering for Kelly drilling, double-head drilling or also for endless screw drilling, for example. Kelly drilling is among the most common drilling methods and is used, above all, for the production of bored piles for pile foundations. A mast, called a leader in technical language, on which the work devices, here drilling drives, are moved, is characteristic for rotary drilling implements. Usually, the work devices are held by an advancing carriage that can be moved by way of an advancing system and can be preloaded with great force. Advancing regularly takes place by way of cables, an upper cable for pulling the drilling implement and a lower cable by way of which the drilling implement is pulled downward. The cables used generally have a diameter of between 20 mm and 30 mm.

Usually, an advancing winch is used as the advancing drive for the advancing carriage, on which winch the upper cable and lower cable are wound onto a drum, and which winch simultaneously unspools one cable and winds up the other cable as its cable drum rotates. Both cables can be attached directly to the advancing carriage. Alternatively, two deflection drums are installed on the advancing carriage, by means of which drums the upper cable and the lower cable are deflected by 180° and guided to assigned fixed points on the leader.

In order to guarantee problem-free movement of the advancing carriage with the work device held by it, it is necessary that the advancing cables, which lengthen under a load, are continuously tensioned. On the other hand, the cables must be relaxed again for transport of the construction machine, so as to prevent them from being damaged when the mast is laid down onto the carrier device. Because lengthening of the cables occurs over the course of time due to a constant load, usually at least one of the advancing cables is attached to a cable tensioning cylinder. Because the displacement path of such a cable tensioning cylinder is limited by the available free space on the leader, the cables must regularly be re-tightened, at the latest once the tensioning cylinder has reached its maximal displacement path. In this regard, re-tightening takes place either at the connection to the cable tensioning cylinder or at the fixed point. For this reason, it is necessary that the cable ends at which re-tightening takes place are connected with the leader or with the cable tensioning cylinder by way of a releasable cable end connection. A cable end connection that is releasable, on the one hand, and does not impair the strength of the cable, on the other hand, has not become known until now. Usually, wedge sockets are used as releasable cable end connections, but these devices reduce the cable strength by about 20%. Therefore the cable diameters must be dimensioned correspondingly larger, and this increase of dimensions leads to increased mass and additional required construction space. Furthermore, thicker cables require larger radii of the cable rollers.

Furthermore, both installation and cable re-tightening are problematic due to the small bending radius in the wedge socket, above all in the case of larger cable diameters. Before installation, cable clamps must be installed to pull the cable ends, which have been cut to a point, and this procedure can lead to damage of the outer strands. Furthermore, precise adjustment of the cable length, which is necessary so as to lose as little displacement path of the cable tensioning cylinder as possible, proves to be difficult. Also, improper re-tightening, particularly under construction site conditions, can lead to friction contact in the region of the cable run-in and cable run-out, and thereby to damage of the outer strands.

The above sets of problems exist analogously for pile-driving implements, on which advancing winches are also used. In the case of pile-driving implements, a hydraulic cylinder frequently serves as the drive for advancing, with a distinction being made between different concepts. In the case of telescoping leaders, at least two leader parts are displaced relative to one another by means of hydraulic cylinders, wherein the change in length of the leader is transferred to the advancing carriage by way of advancing the cable. In the case of rigid leaders, both winches and hydraulic cylinders are used as a drive for advancing the cable. Advancing of the winch functions according to the same principle as in the case of drilling rigs.

In terms of design, telescoping leaders in which a first leader part is guided on a second leader part and arranged so that it can be displaced in the longitudinal direction, by way of a hydraulic cylinder, should be distinguished from the above. Two advancing cables run by way of the first leader part: an upper advancing cable that is passed to the advancing carriage at the upper end of the leader, by way of an upper deflection roller, and a lower advancing cable that is passed to the advancing carriage by way of the lower deflection roller. The advancing carriage is guided on the first leader part and can be displaced in the longitudinal direction. Both cables are attached to the advancing carriage with one end. With the other end, in each instance, the cables are attached to a fixed point on the second leader part, in each instance. When the leader parts are displaced relative to one another, the advancing carriage, which is guided on the first leader part, moves at twice the speed. Because two cables are often installed parallel in the case of telescoping leaders, these cables must be tensioned comparably, so as to ensure uniform support.

SUMMARY OF THE INVENTION

Against this background, the present invention is based on the task of making available a construction machine for special civil engineering, of the aforementioned type, for which both easy installation and re-tightening of the advancing cable is made possible without impairing the cable strength. This task is accomplished with the characteristics according to the invention.

With the invention, a construction machine for special civil engineering, of the aforementioned type, is made available, which allows both easy installation and re-tightening of the advancing cable without impairing the cable strength. Because the cable tensioner comprises a tensioning drum on which an end-side section of an advancing cable is attached with multiple, preferably at least three cable windings, releasable end attachment of an advancing cable is achieved without impairment of the cable strength. Re-tensioning of the advancing cable takes place by way of a rotation of the tensioning drum, wherein—contrary to the tensioning cylinders used in the state of the art—no restrictions caused by construction space exist. Preferably, the end of the advancing cable held by the tensioning drum is attached to the tensioning drum of the cable tensioner by way of a clamping wedge.

In a further development of the invention, the advancing cables are wound onto a drum on a drive winch with a first end. Alternatively, the advancing cables can also be guided by way of cable rollers of a drive carriage, which can be displaced by way of a drive cylinder, in particular a hydraulic cylinder, which is attached to the leader. In this way, reliable drive of the advancing carriage in both longitudinal directions along the leader is made possible.

The cable tensioner according to the invention, which has a cable drum, must be distinguished, in the present case, from a drive/advancing winch that forms the drive for the advancing cables. Although this cable tensioner also allows winding up or unwinding an advancing cable attached to it, it does not serve for drive of the advancing cables; for this purpose, a drive winch or a drive hydraulic cylinder is additionally present. In contrast to a drive winch, this cable tensioner is not able to bring about displacement of the advancing carriage in its two directions of movement.

In an embodiment of the invention, at least one of the advancing cables is deflected by way of at least one deflection roller affixed to the advancing carriage, and attached to a fixed point on the leader with its second end. In an alternative embodiment of the invention, the leader is a telescoping leader that comprises a first leader part and a second leader part guided on the first, as well as a hydraulic cylinder by way of which the second leader part (outer leader) can be displaced in the longitudinal direction along the first leader part (inner leader), wherein the first advancing cable and the second advancing cable are attached, in each instance, with a fixed point of the first leader with one end and with a fixed point of the advancing carriage with the other end. In this way, reliable drive of the advancing carriage in both longitudinal directions of the leader is achieved using the hydraulic cylinder.

In a further development of the invention, the cable tensioner has means for locking the tensioning drum in at least one position of rotation. In this way, easy re-tensioning of the advancing cable is made possible by rotation of the tensioning drum and subsequent locking in place.

In an embodiment of the invention, the means for locking comprise a bolt that can be inserted through a first bore of a first bore pattern of a cable tensioner housing that surrounds the tensioning drum, at least in certain regions, into a second bore of a second bore pattern arranged in the tensioning drum. In this way, finely graduated re-tensioning is made possible, depending on the design of the bore pattern.

In a further development of the invention, the bore pattern of the cable tensioner housing and the bore pattern of the tensioning drum have different angle scales. In this way, a great number of securing positions is achieved.

In an embodiment of the invention, two securing bores are arranged in the cable tensioner housing at an angle of 150° relative to one another with reference to the axis of rotation of the tensioning drum, and six securing bores are present in the tensioning drum, which are arranged at an angle of 60° relative to one another, in each instance, with reference to the axis of rotation of the tensioning drum. In this way, locking in place of the cable drum in a raster of 30° steps is made possible. With further bores, the step width can be further reduced in size, for example, by means of two additional bores in the housing, to 10°.

In a further embodiment of the invention, the tensioning drum has a holder for attaching a chain hoist or some other tensioning apparatus. In this way, manual re-tensioning of the tensioning cables is made possible.

In a further development of the invention, the tensioning drum is connected with a motor, by way of which it can be driven. In this way, automatic re-tensioning of the preloaded cables is made possible.

In an embodiment of the invention, the tensioning drum is connected with a gear mechanism. In this way, a reduction in the torque required for re-tensioning is achieved. Preferably, the gear mechanism is a worm gear mechanism or an epicyclic gear mechanism or also a cycloid gear mechanism.

In an advantageous embodiment of the invention, the gear mechanism is a self-locking gear mechanism that is configured so that drive cannot take place by way of the tensioning drum. In this way, infinite re-tensioning of the advancing cable is made possible. Preferably the self-locking gear mechanism is a worm gear mechanism or a self-locking planetary gear mechanism. Alternatively, the tensioning drum can also be provided with a brake that is released only when the tensioning drum is supposed to apply tension or relax it.

In a further development of the invention, the cable tensioner comprises at least one sensor for detecting the cable tension that is in effect. In this regard, the sensor is preferably connected with an evaluation and display module for displaying the current cable tension. Alternatively or in addition, the sensor can be connected with a control and regulation device by way of which a motor connected with the cable drum can be controlled, and which is set up for automatically correcting the cable tension by way of controlling the motor, based on a comparison of the actual cable tension values determined by the sensor with a stored reference cable tension value or a stored reference cable tension range. In this way, an extensively constant cable tension can be achieved.

In an embodiment of the invention, the at least one sensor for detecting the applied cable tension is a load pin that is arranged in the tensioning drum. Alternatively or in addition, a sensor for detecting the supporting loads of the cable tensioner can be provided.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
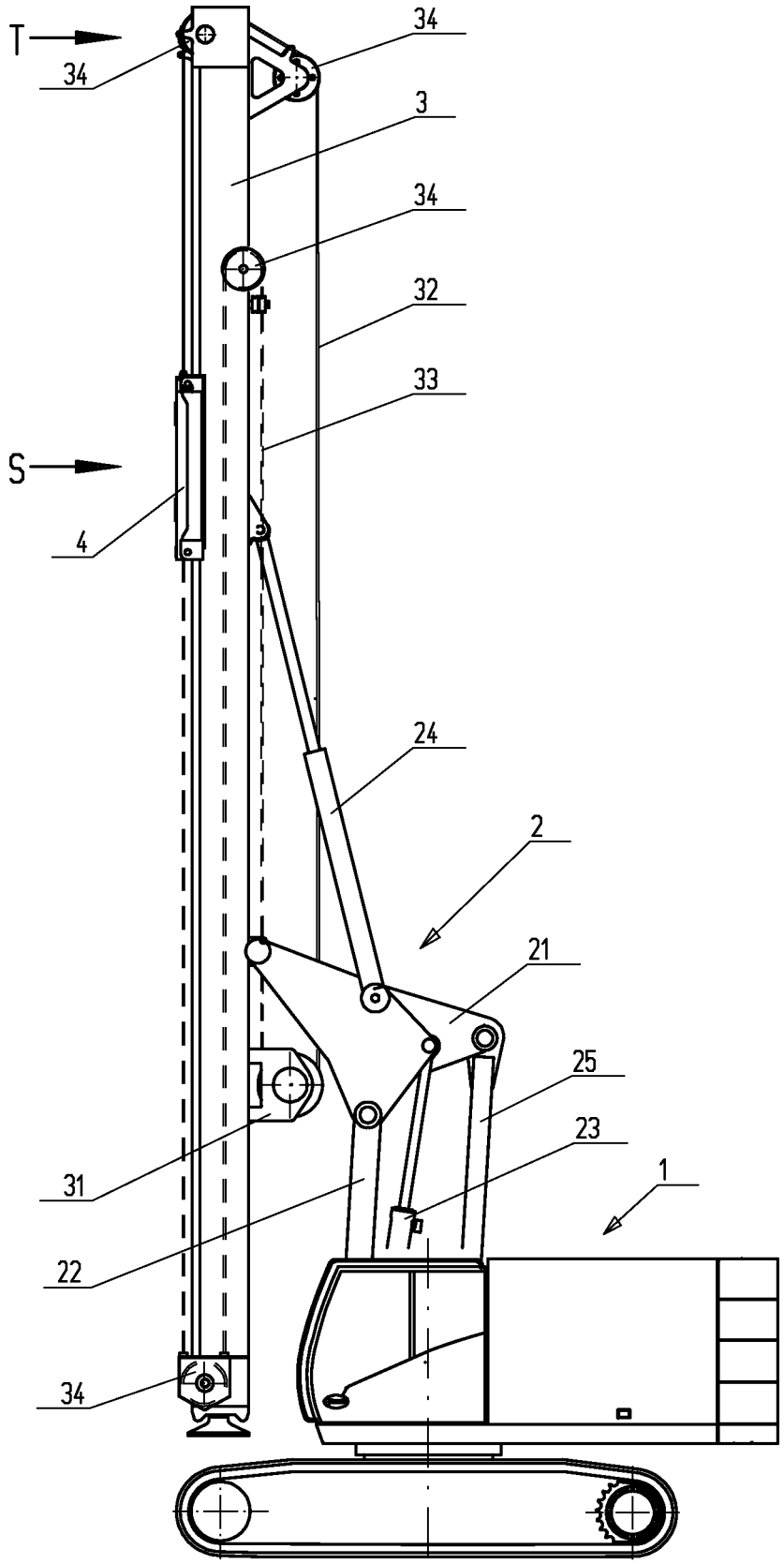
FIG. 1 shows the schematic representation of a construction machine for special civil engineering.

The construction machine selected as an exemplary embodiment is structured as a drilling rig and essentially consists of a carrier 1 that is connected, by way of a swing arm 2, with a leader 3, on which an advancing carriage 4 is displaceably arranged to hold a drilling implement, not shown. An advancing winch 31 is attached to the leader 3, by way of which winch the advancing carriage 4 can be displaced in both directions along the leader 3. For this purpose, an upper cable 32 and a lower cable 33 are wound up on a drum on the drive winch 31, in such a manner that when one of these two cables is wound up, the other one is unwound, and vice versa.

The swing arm 2 comprises two swing plates 21 arranged parallel to one another and essentially configured in triangular shape, the corners of which are rounded off. The swing plates 21 of the swing arm 2, lying opposite one another, are connected with one corner with one part 22, 25, of the parallel kinematics, in each instance, so as to pivot, which kinematics are attached to the carrier 1 so as to pivot. With a second corner, the swing plates 21, lying opposite one another, are connected with the leader 3 so as to pivot. The third corner of the swing plates 21, in each instance, is connected with a boom cylinder 23 that is arranged on the carrier 1. At a distance from the boom cylinder 23, a support strut cylinder 24 is attached, so as to pivot, in each instance, in the region of the third corner of the swing plates 21, the cylinder piston of which is attached to the leader 3 so as to pivot, in each instance.

Figure 3:
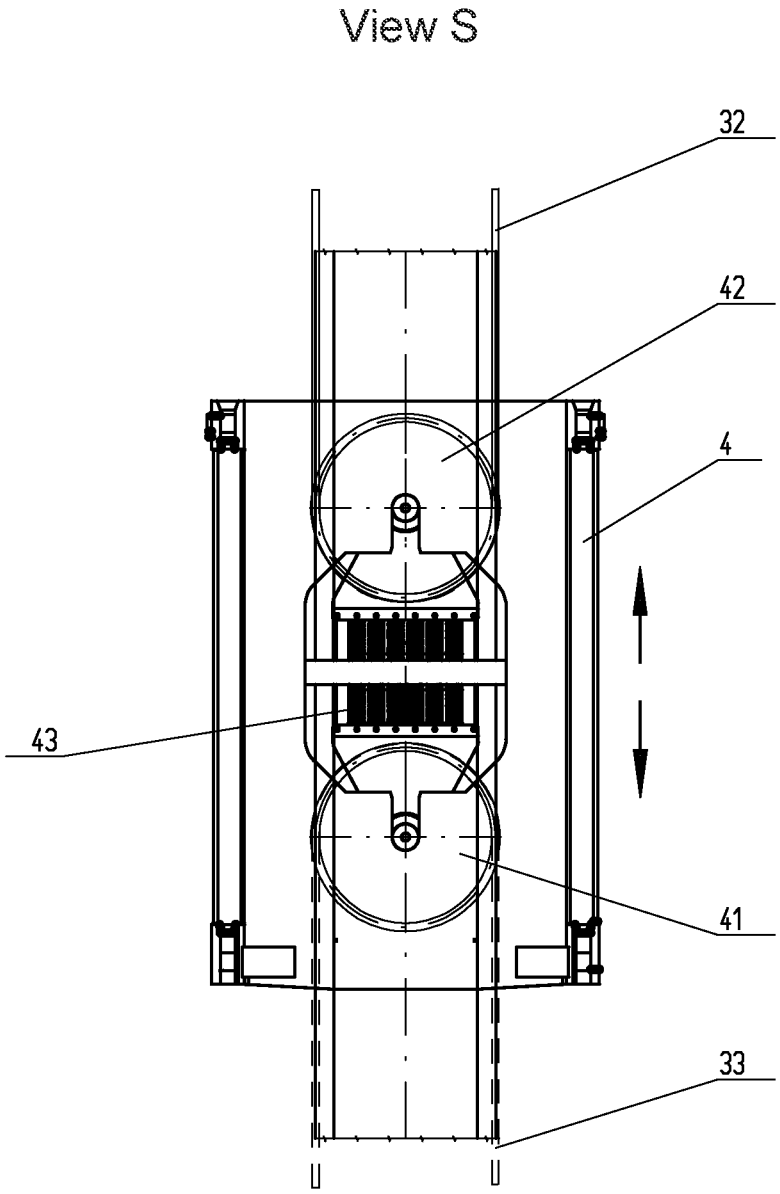
FIG. 3 shows the detail representation of the section S of the construction machine from FIG. 1.
Figure 4:
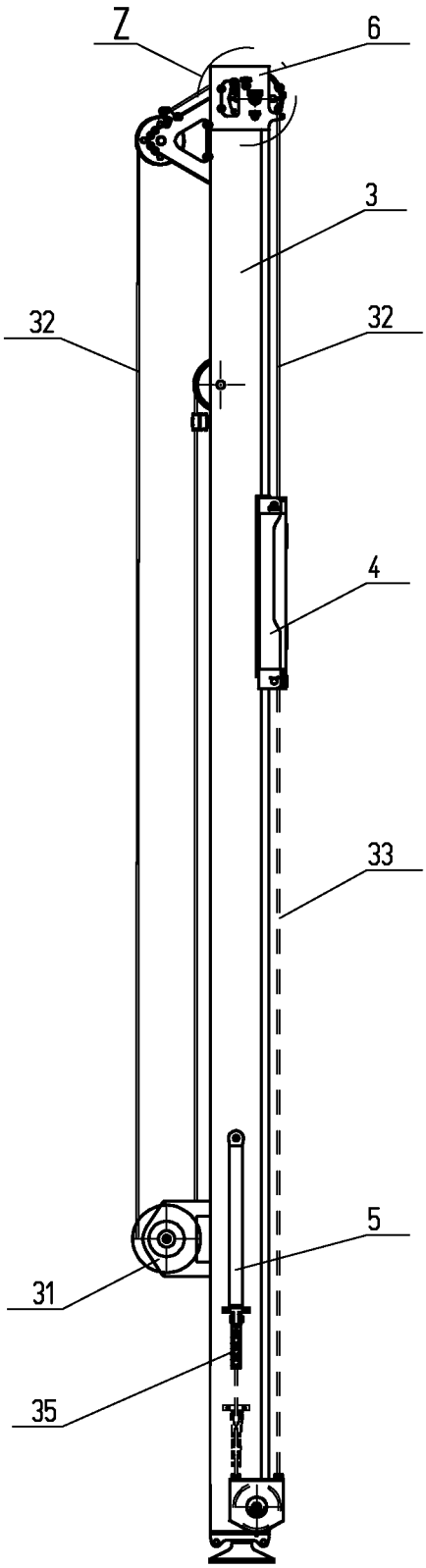
FIG. 4 shows the representation of the leader of the construction machine from FIG. 1.
Figure 5:
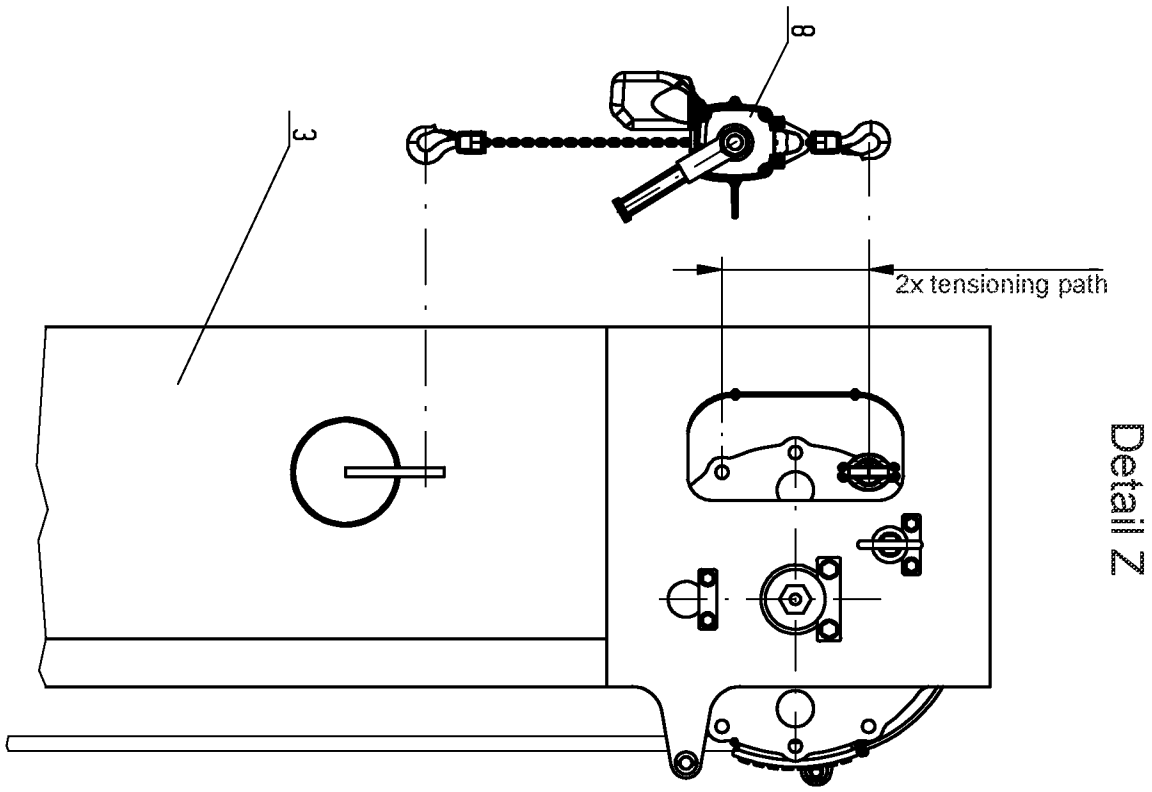
FIG. 5 shows the detail representation of the section Z of the leader from FIG. 4.
Figure 6:
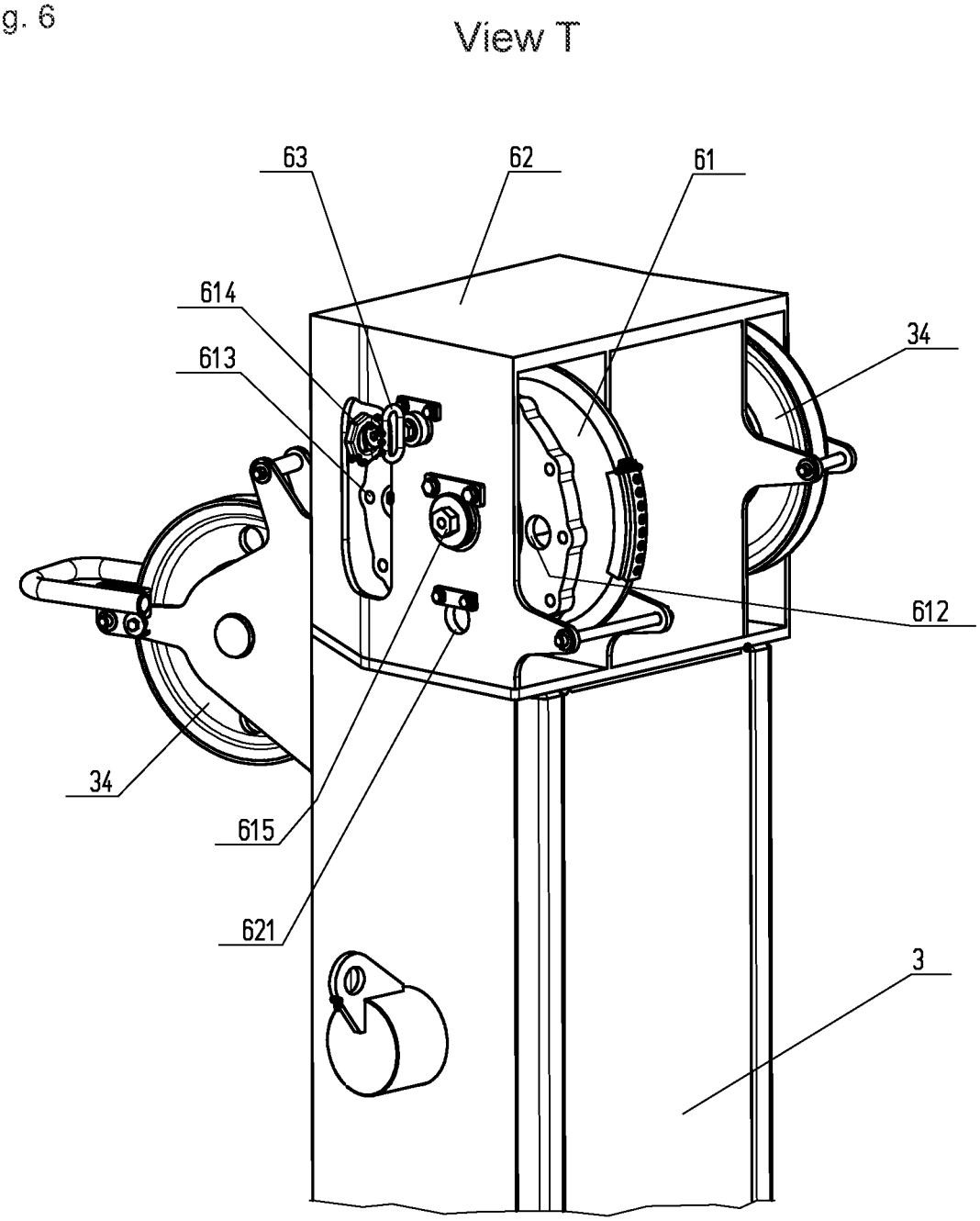
FIG. 6 shows the representation of the section Z of the leader from FIG. 4 in spatial representation.

As shown in FIGS. 1, 3, and 4, the lower cable 33 is passed to the advancing carriage 4 along the leader 3 about two deflection rollers 34 attached to the leader, where it is passed around a first deflection roller 41 attached to the carriage to a foot-side fixed point of the leader 3, by way of a further deflection roller 34 attached to the leader 3. The fixed point is formed by a cable tensioning cylinder 5 that is connected with the cable end of the lower cable by way of a clamping wedge 35.

The upper cable 32 is passed to the advancing carriage 4 along the leader by way of two deflection rollers 34 attached to the leader, and there it is passed to a head-side fixed point of the leader 3 around a second deflection roller 42 attached to the carriage. The cable guidance of upper cable 32 and lower cable 33 around the deflection rollers 41, 42 attached to the advancing carriage 4 is shown in FIG. 3. As is evident there, the two deflection rollers 41, 42 are connected with the advancing carriage by way of spring packages 43.

Figure 2:
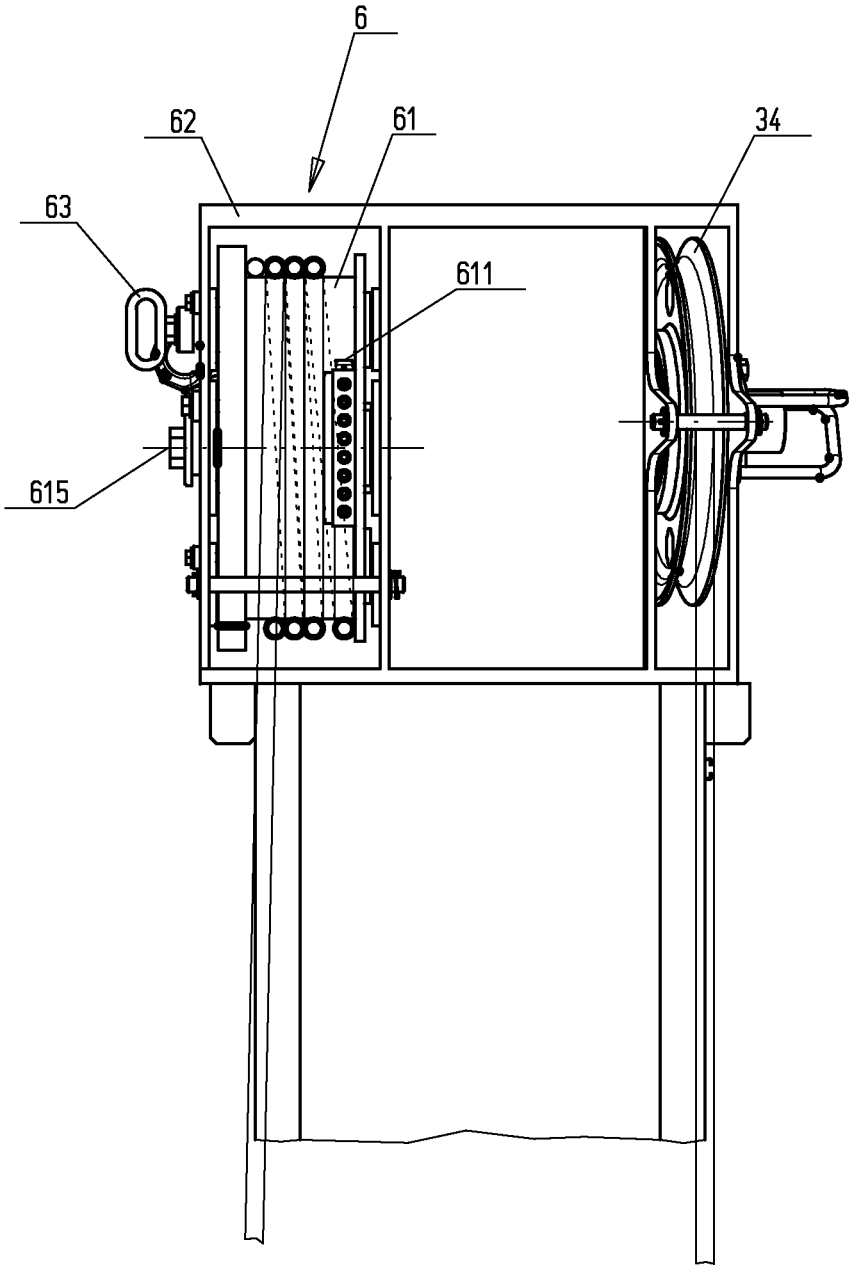
FIG. 2 shows the detail representation of the section T of the construction machine from FIG. 1.

The head-side fixed point is formed by a cable tensioner 6. The cable tensioner 6 is shown in FIG. 2. It comprises a tensioning drum 61, which is mounted in a tensioning housing 62 so as to rotate. The upper cable 32 is attached to the tensioning drum 61 by means of three cable windings, wherein the cable end of the upper cable 32 is connected with the tensioning drum 61 by way of a clamping wedge 611 and a clamping bolt 616. The width of the tensioning drum 61 is selected in such a manner that at least one free winding is present to hold the cable during the course of a re-tensioning process.

The tensioning drum 61 can be locked in place in different positions of rotation by way of a locking bolt 63. In this regard, the locking bolt penetrates both the tensioning housing 62 and the tensioning drum 61 mounted in it. For this purpose, a first bore pattern is introduced into the tensioning housing 62, which pattern comprises two securing bores 621 that are arranged offset from one another by an angle of 150° around the axis of rotation of the tensioning drum 61. Furthermore, a second bore pattern is present in the tensioning drum 61, which comprises six securing bores 612, which are each arranged offset from one another by 60° around the axis of rotation of the tensioning drum 61. By means of the two bore patterns of tensioning drum 61 and tensioning housing 62, locking of the tensioning drum in a raster of 30° is made possible. A reduction in the step width is possible by way of placement of further securing bores 612, 621, for example by means of placement of two further securing bores 621 in the tensioning housing to 10°.

Figure 7:
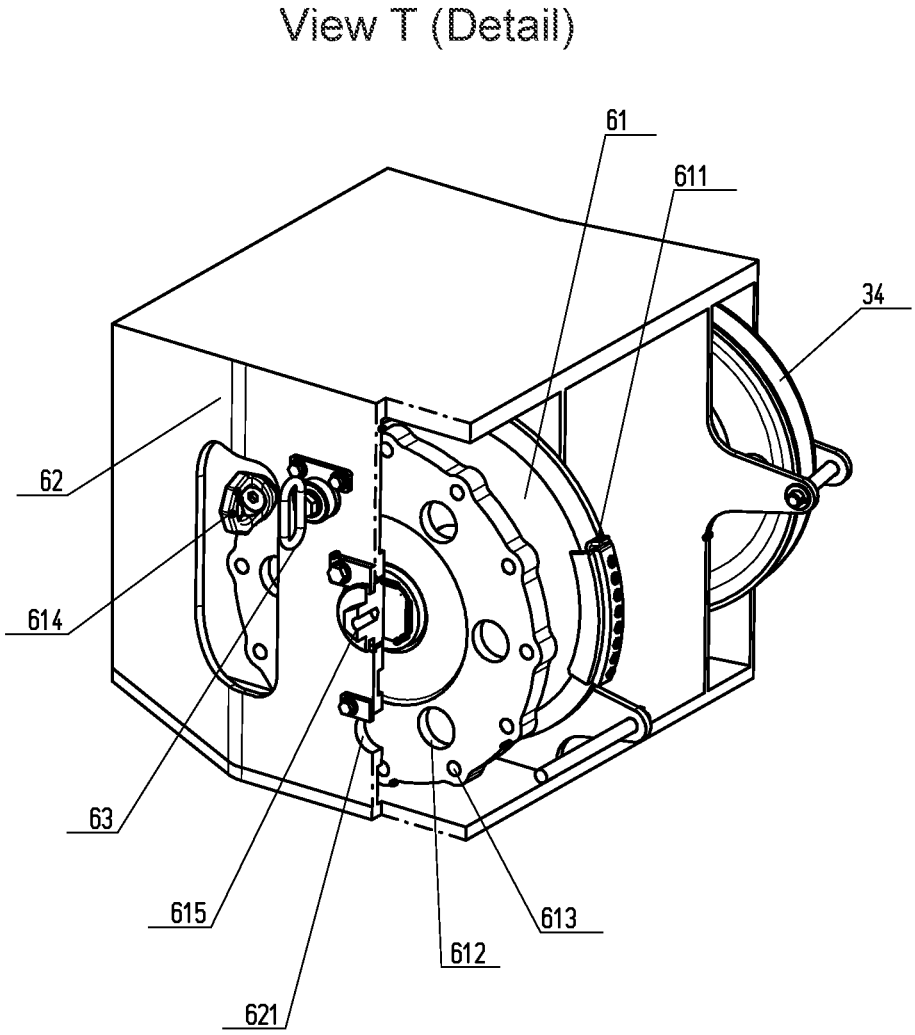
FIG. 7 shows the enlarged detail representation of the tensioning apparatus of the leader from FIG. 4.
Figure 8:
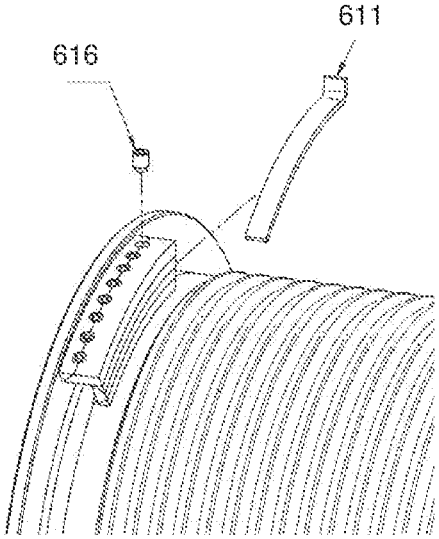
FIG. 8 shows the enlarged detail representation of the cable attachment at the tensioning drum of the tensioning apparatus from FIG. 7.

For connection of tensioning elements, for example a chain hoist 8, threaded bores 613 are furthermore circumferentially introduced into the tensioning drum 61. In FIG. 7, a tensioning eyebolt 614 is screwed into a threaded bore 613 as an example. Furthermore, a hexagon 615 is arranged in the center of the tensioning drum shaft of the tensioning drum 61, by way of which hexagon the tensioning drum 61 can be manually rotated using a hex wrench, not shown. Instead of the hexagon 615, any other suitable tool holder can also be provided. The tensioning drum shaft is firmly connected with the tensioning drum 61.

For re-tensioning the advancing cables 32, 33, first a tensioning element, for example a chain hoist 8, is connected and preloaded by way of a tensioning eyebolt 614 that is screwed into a threaded bore 613 of the tensioning drum 61. Subsequently, the locking bolt 63 is tightened. The tensioning drum is now rotated by way of the tensioning element, and thereby the upper cable 32 is wound onto the cable drum. After the desired cable tension has been achieved, the locking bolt is passed through a securing bore 621 of the tensioning housing 62 and a securing bore 612 of the tensioning drum 61 that aligns with it, whereby it is locked in place. Subsequently the tensioning element can be removed.

For re-tensioning, a gear mechanism can also be connected with the tensioning drum shaft as a tensioning element, by way of which re-tensioning by hand is made possible. It is also possible to connect the tensioning drum shaft with a motor that is attached to the leader or the tensioning housing, and by way of which re-tensioning takes place. Automatic re-tensioning would also be made possible by way of such a motor, wherein the motor should be controlled by a control and regulation apparatus, the input variable of which is the applied actual cable tension, and the output variable of which is a predetermined reference cable tension. To detect the applied actual tension, a sensor can be installed for detecting the cable tension, for example in the form of a load pin in the tensioning drum 61 or a sensor for detecting the supporting loads of the advancing cable. On the basis of the measured forces, the applied cable tension can be calculated by way of a calculation module. Alternatively, a memory unit can also be provided, in which cable tensions determined by individual measurements are stored and assigned to the forces determined for them.

Alternatively or also in addition, the cable tensioner 6 according to the invention can be affixed as a lower cable fixed point (instead of the cable tensioning cylinder 5). By way of the cable tensioner 6 configured in this manner, it is additionally made possible to correct the position of the advancing carriage 4 on the leader 3 and to adjust the end position, for example. Furthermore, the possibility exists of dimensioning the tensioning drum 61 in such a manner that a cable storage area is formed. This arrangement is particularly advantageous if the leader of the construction machine is composed of segments and is adapted as a function of the work task. For example, it can be necessary to disassemble a leader segment when working under bridges. While in the case of construction machines of the state of the art, a different advancing cable must be laid on in the event of such a modification, a correspondingly dimensioned tensioning drum 61 offers the possibility of taking up several meters of advancing cable and dispensing it again in the event of a return to a greater leader length.

Figure 9:
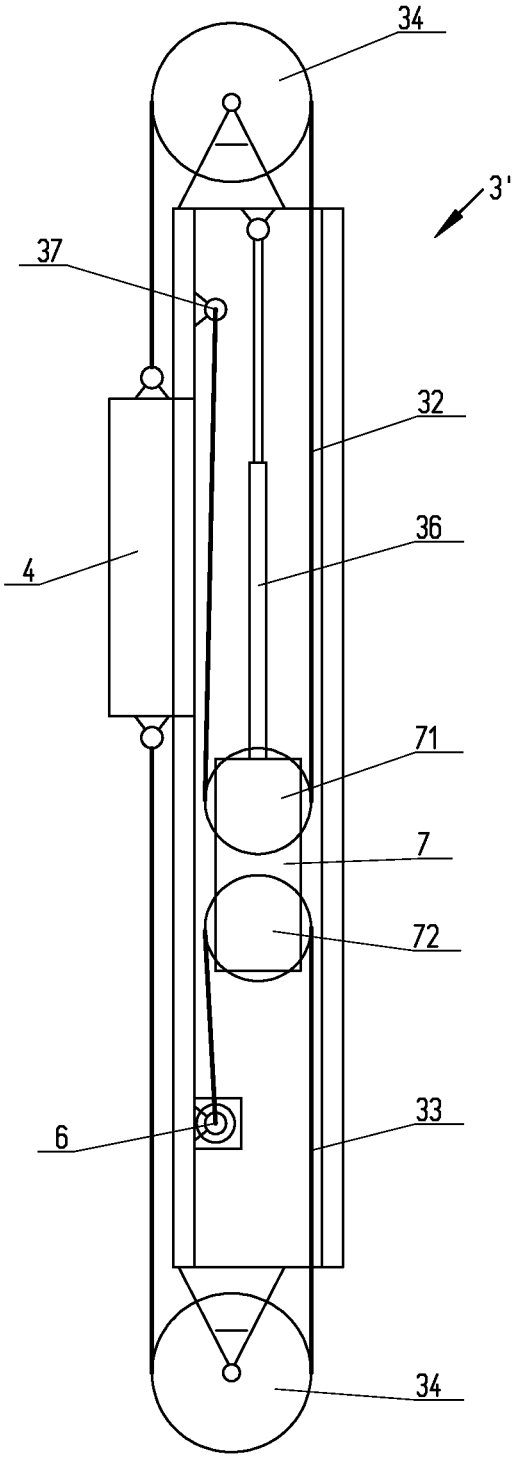
FIG. 9 shows the schematic representation of the leader of a construction machine for special civil engineering in a further embodiment.

In FIG. 9, a leader 3' of a further embodiment of a construction machine according to the invention is shown schematically. Here, a drive carriage 7 is mounted in the leader 3' in longitudinally displaceable manner, which carriage is connected with a hydraulic cylinder 36, by way of which it can be displaced. The drive carriage 7 has two deflection rollers arranged vertically at a distance from one another, a first upper deflection roller 71 and a second lower deflection roller 72. In this embodiment, the upper cable 32 is firmly connected with the advancing carriage 4 and passed over a deflection roller 34 arranged on the leader on the head side, as well as around the first deflection roller 71 of the drive carriage 7, and after that attached to a first fixed point 37 of the leader. The lower cable 33, lying opposite the upper cable 32, is firmly connected with the advancing carriage 4 and passed over a deflection roller 34 arranged on the leader on the head side, as well as around the second deflection roller 72 of the drive carriage 7, and afterward attached to a second fixed point that is formed by a cable tensioner 6. The cable tensioner 6, which is merely indicated symbolically in FIG. 9, corresponds to the cable tensioner 6 described above using FIG. 2.

Advancing is initiated by the hydraulic cylinder 36, which moves the drive carriage 7 guided in the leader 3'. The movement of the drive carriage 7 is turned into a movement of the advancing carriage 4 in the opposite direction, at twice the speed, by way of the deflection rollers 71, 72. Upper cable 32 and lower cable 33 can be re-tensioned by way of the cable tensioner 6 that forms the one fixed point.

Figure 10:
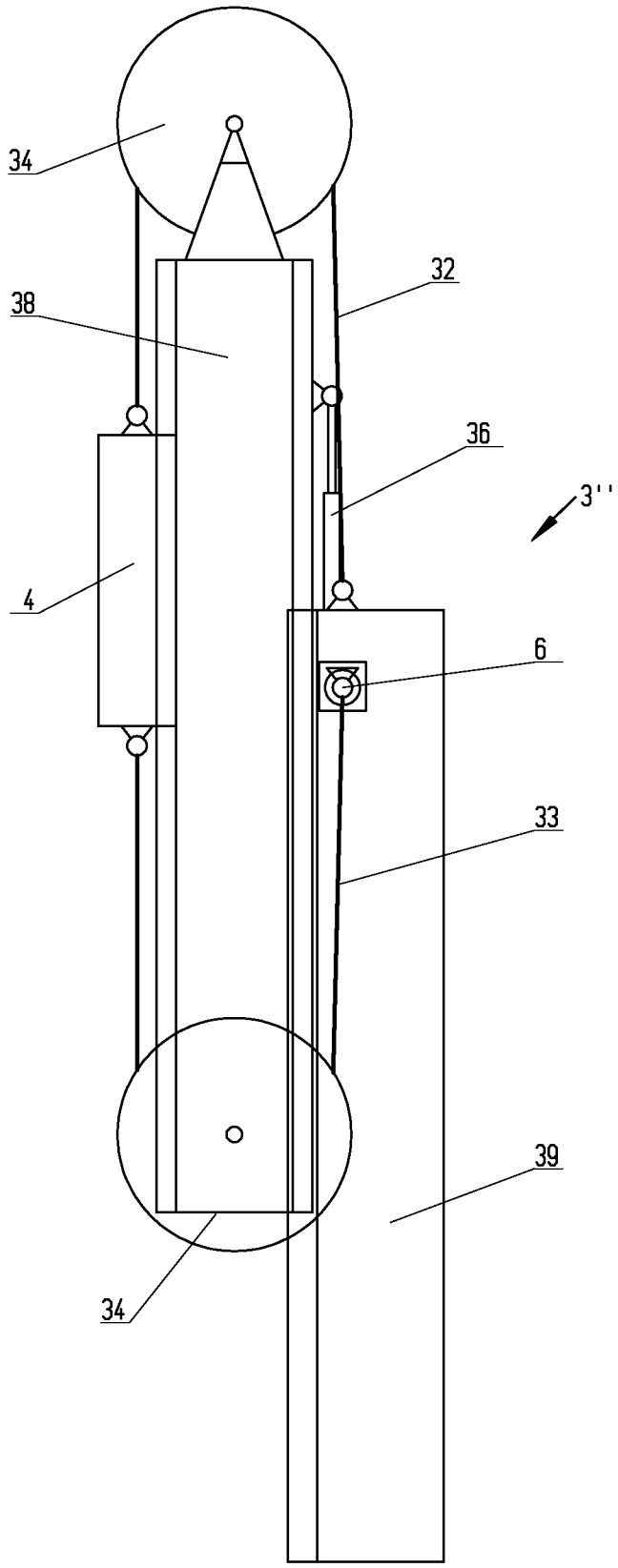
FIG. 10 shows the schematic representation of the leader of a construction machine for special civil engineering in a third embodiment.

In FIG. 10, a leader 3" of a third embodiment of a construction machine according to the invention is shown schematically. Here, the leader 3" is configured as a telescoping leader, having an outer leader 38 that can be displaced in the longitudinal direction on an inner leader 39, by way of a hydraulic cylinder 36. Outer leader 38 and inner leader 39 are connected with one another by way of the hydraulic cylinder 36. In this embodiment, the upper cable 32 is firmly connected with the advancing carriage 4 and passed over a deflection roller 34 arranged on the outer leader 38, on the head side, and afterward it is attached to a first fixed point 37 of the inner leader 39. The lower cable 33, lying opposite the upper cable 32, is firmly connected with the advancing carriage 4 and passed over a deflection roller 34 arranged on the outer leader 38 on the foot side, and afterward it is attached to a second fixed point that is formed by a cable tensioner 6. The cable tensioner 6, which is also merely indicated symbolically in FIG. 10, once again corresponds to the cable tensioner 6 described using FIG. 2.

If inner leader 39 and outer leader 38 are displaced relative to one another by way of the hydraulic cylinder 36, then the advancing carriage 4 guided on the outer leader 38 moves at twice the speed. Once again, re-tensioning of upper cable 32 and lower cable 33 takes place by way of the cable tensioner 6, which forms the one fixed point.

Although only a few embodiments of the present invention have been shown and described, it is to be understood that many changes and modifications may be made thereunto without departing from the spirit and scope of the invention.

What is claimed is:

1. A construction machine comprising:

(a) a leader;

(b) an advancing carriage guided on the leader and comprising a holder for a work device;

(c) a first advancing cable and a second advancing cable for moving the advancing carriage along the leader;

(d) a drive winch or a drive cylinder connected with the first advancing cable and the second advancing cable for displacing the advancing carriage using the first advancing cable and the second advancing cable;

wherein at least one of the first advancing cable and the second advancing cable is attached to a first fixed point on the leader or to the advancing carriage or to both the leader and the advancing carriage;

wherein a second fixed point is formed by a cable tensioner attached to the leader or the advancing carriage;

wherein the cable tensioner comprises a tensioning drum and an end-side section of the first advancing cable or the second advancing cable is attached on the tensioning drum with a plurality of cable windings of the first advancing cable or the second advancing cable; and wherein the cable tensioner has a lock configured to lock the tensioning drum in at least one position of rotation.

2. The construction machine according to claim 1, wherein the work device is a drilling rig or a pile-driving implement.

3. The construction machine according to claim 1, wherein the end-side section of the advancing cable is attached to the tensioning drum with at least three cable windings.

4. The construction machine according to claim 1, further comprising a clamping wedge, wherein the end-side section of the first advancing cable or the second advancing cable held by the tensioning drum is attached to the tensioning drum of the cable tensioner by way of the clamping wedge.

5. The construction machine according to claim 1, wherein the first and second advancing cables are wound onto a drum on the drive winch with a first end, or are guided by way of drive carriage deflection rollers of a drive carriage, wherein the drive carriage is displaceable by way of the drive cylinder attached to the leader.

6. The construction machine according to claim 5, wherein the drive cylinder is a hydraulic cylinder.

7. The construction machine according to claim 5, wherein at least one of the first and second advancing cables is deflected by way of at least one deflection roller affixed to the advancing carriage, and attached to the second fixed point on the leader with a second end of the at least one of the first and second advancing cables.

8. The construction machine according to claim 1, wherein the leader is a telescoping leader that comprises a first leader part, a second leader part guided on the first leader part, and a hydraulic cylinder, wherein the second leader part is displaceable by the hydraulic cylinder in a longitudinal direction along the first leader part, wherein the first advancing cable and the second advancing cable are respectively attached with a first fixed point of the first leader part with a first end and with a second fixed point of the advancing carriage with a second end.

9. The construction machine according to claim 1, wherein the lock comprises a locking bolt insertable through a first securing bore of a first bore pattern of a cable tensioner housing that surrounds the tensioning drum, at least in certain regions, into a second securing bore of a second bore pattern arranged in the tensioning drum and/or wherein the lock comprises a brake.

10. The construction machine according to claim 9, wherein the first bore pattern of the cable tensioner housing and the second bore pattern of the tensioning drum have different angle scales.

11. The construction machine according to claim 10, wherein two securing bores are arranged in the cable tensioner housing at an angle of 150° relative to one another with reference to an axis of rotation of the tensioning drum, and six securing bores are present in the tensioning drum, wherein the six securing bores are arranged at an angle of 60° relative to one another with reference to the axis of rotation of the tensioning drum.

12. The construction machine according to claim 1, wherein the tensioning drum is connected with a motor for driving the tensioning device and/or wherein the tensioning drum is connected with a gear mechanism and/or wherein the tensioning drum has holders for attaching a chain hoist or a tensioning apparatus other than a chain hoist.

13. The construction machine according to claim 12, wherein the gear mechanism is a worm gear mechanism or an epicyclic gear mechanism or a cycloid gear mechanism.

14. The construction machine according to claim 12, wherein the gear mechanism is a self-locking gear mechanism that is configured so that drive cannot take place by way of the tensioning drum.

15. The construction machine according to claim 1, wherein the cable tensioner comprises at least one sensor for detecting a cable tension that is in effect.

16. The construction machine according to claim 15, wherein the sensor is connected with an evaluation and display module for displaying the current cable tension and/or connected with a control and regulation device for control of a motor connected with the tensioning drum, wherein the control and regulation device is set up for automatically correcting the cable tension by way of controlling the motor, based on a comparison of actual cable tension values determined by the sensor with a stored reference cable tension value or a stored reference cable tension range and/or wherein the at least one sensor for detecting the applied cable tension is a load pin in the tensioning drum and/or a sensor for detecting the supporting loads of the cable tensioner.

* * * * *